US007837024B2

(12) United States Patent
Flagg

(10) Patent No.: US 7,837,024 B2
(45) Date of Patent: Nov. 23, 2010

(54) PACKAGING MACHINE WITH SYSTEM FOR SUPPORTING AND POSITIONING A PLUNGER ASSEMBLY

(75) Inventor: Michael F. Flagg, Newnan, GA (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 533 days.

(21) Appl. No.: 11/936,363

(22) Filed: Nov. 7, 2007

(65) Prior Publication Data

US 2008/0104933 A1 May 8, 2008

Related U.S. Application Data

(60) Provisional application No. 60/864,765, filed on Nov. 7, 2006.

(51) Int. Cl.
*B65G 57/26* (2006.01)

(52) U.S. Cl. ..... 198/429; 248/548; 248/909; 198/433; 198/456

(58) Field of Classification Search ..... 198/418.7, 198/429, 433, 456; 248/548, 909
See application file for complete search history.

(56) References Cited

U.S. PATENT DOCUMENTS 4,273,489 A * 6/1981 Lingl et al. ..... 198/418.2
4,362,235 A * 12/1982 Erdmann ..... 198/418.3
4,371,076 A * 2/1983 Nakao ..... 198/418.2
4,661,038 A * 4/1987 Kohler et al. ..... 414/730
5,002,173 A * 3/1991 Hucul et al. ..... 192/150
5,360,306 A * 11/1994 Nakayama et al. ..... 414/331.08
5,472,077 A * 12/1995 Bolin ..... 198/430
5,484,219 A * 1/1996 Drew et al. ..... 403/57
5,697,480 A * 12/1997 Herbermann et al. .... 192/56.32
6,503,043 B1 * 1/2003 Smith et al. ..... 414/331.14
6,540,196 B1 * 4/2003 Ellsworth ..... 248/548
7,056,056 B2 * 6/2006 Wiegand et al. ..... 404/10
7,185,751 B2 * 3/2007 Guidetti ..... 198/418.6
7,264,108 B2 * 9/2007 Borsarelli et al. ..... 198/429
7,325,668 B2 * 2/2008 Borsarelli et al. ..... 198/430
7,374,033 B2 * 5/2008 Monti ..... 198/432
7,396,200 B2 * 7/2008 Reguzzi ..... 414/331.14

* cited by examiner

*Primary Examiner*—Douglas A Hess
(74) *Attorney, Agent, or Firm*—MWV Intellectual Property Group

(57) ABSTRACT

A packaging machine includes an article conveyor for transporting articles in a flow direction and a plunger assembly for displacing articles from the article conveyor. The plunger assembly is supported and positioned by a system that includes a frame assembly and a pressure sensitive coupling as means for releasably fixing the position of the plunger assembly. The frame assembly includes a first frame structure that is attached to the plunger assembly and a second frame structure. The first frame structure and the second frame structure are slidably coupled to one another such that a resistive force that overcomes the holding power of the pressure sensitive coupling will cause the first frame structure to slide and translate the plunger assembly out of its operating position in which it can displace the articles.

13 Claims, 7 Drawing Sheets

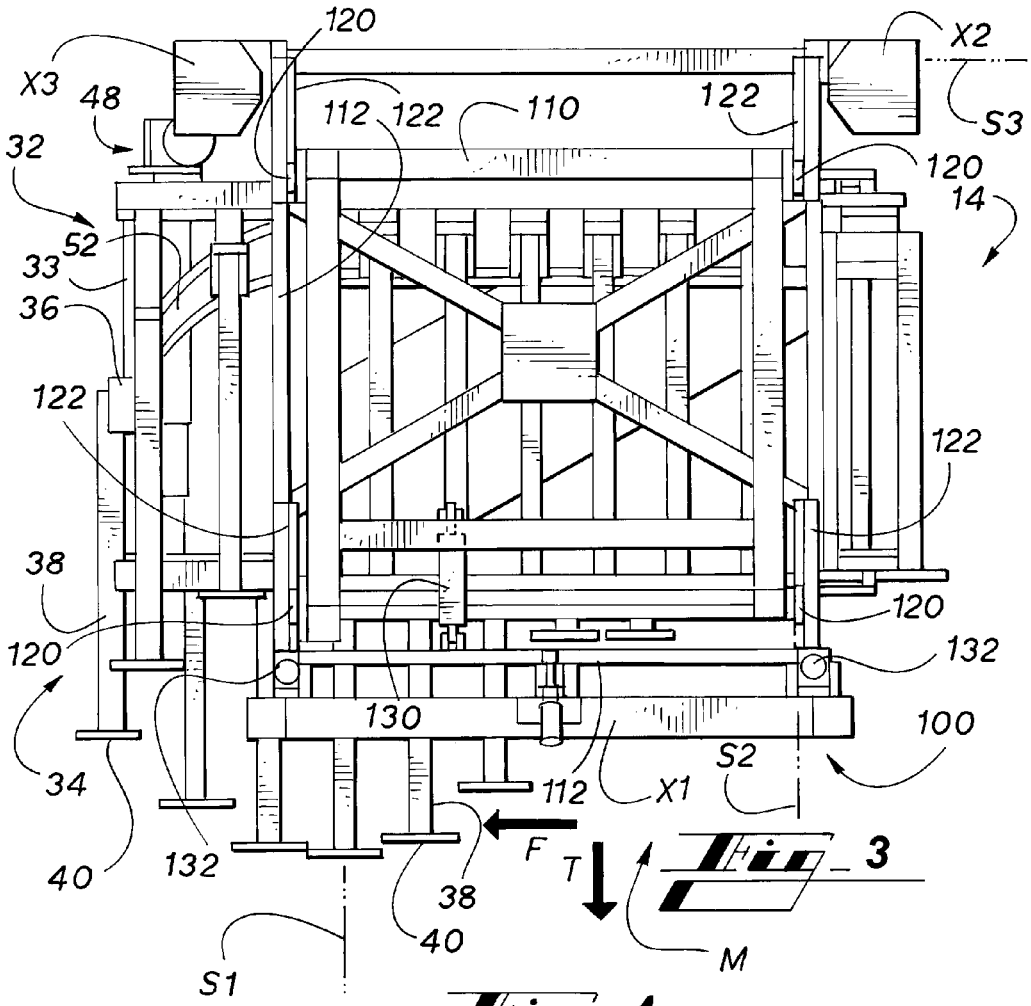
Fig. 3
Fig. 4
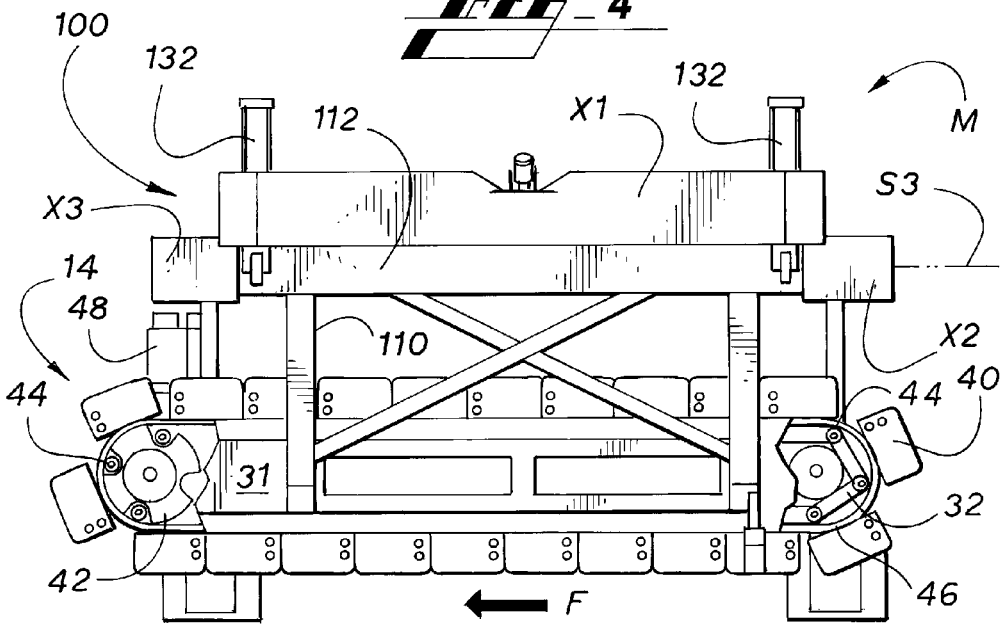

PACKAGING MACHINE WITH SYSTEM FOR SUPPORTING AND POSITIONING A PLUNGER ASSEMBLY

CROSS REFERENCE TO RELATED APPLICATIONS

This application claims priority to U.S. Provisional Application No. 60/864,765, filed Nov. 7, 2006, the entirety of which is herein incorporated by reference.

TECHNICAL FIELD

This invention relates generally to a packaging machine with a plunger assembly, and more specifically, to a system for supporting and positioning a plunger assembly.

BACKGROUND OF THE INVENTION

Packaging machines are useful for loading groups of cylindrical articles, such as cans or bottles, into cartons. In some such machines, the groups of articles travel on one conveyor, open ended cartons travel on a parallel conveyor, and a plunger assembly extends a plunger element to displace the groups of articles into one of the cartons.

Against the present state of the art, there is a need and a resultant market for a plunger assembly that can release pressure on a group of articles in response to an overload condition. In addition, there is a need and a market for a packaging machine that conveniently allows a worker to remove broken or toppled articles.

SUMMARY

The various embodiments of the present invention address the aforementioned needs by providing a packaging machine that includes an article conveyor for transporting articles in a flow direction, a plunger assembly for displacing articles from the article conveyor, and a system for supporting and positioning the plunger assembly. The system provides the plunger assembly with an overload release feature, which can prevent the plunger assembly, for example, from crushing toppled bottles. In addition, in response to an overload condition, the packaging machine is automatically shut down so that, for example, broken or toppled bottles can be cleared. In such a situation, the plunger assembly can be positioned by the system such that workers can access the adjacent conveyor.

According to one aspect of the invention, the system includes a frame assembly and means for releasably fixing the position of the plunger assembly so that the plunger assembly remains in its operating position in the absence of an overload or maintenance condition. The frame assembly includes a first frame structure that is attached to the plunger assembly and a second frame structure. The first frame structure and the second frame structure are slidably coupled to one another. In certain embodiments, the first frame structure is slidably coupled to the second frame structure by a wheel and rail arrangement. In certain embodiments, the second frame structure is rotatable so that the plunger assembly can be pivoted upward or otherwise out of the way, for example, so that a technician can access the article conveyor to clear a toppled article. In certain embodiments, to achieve this rotation, the system includes at least one rotator piston for pivoting the second frame structure. The rotator piston can be activated by a mechanical force exerted to extend and retract the piston arm or electronically, such as by receipt of a control signal. Other suitable means for achieving rotation of the plunger assembly are contemplated, such as any combination of crank wheels, hinges, and the like.

According to another aspect, the invention provides means for releasably fixing the position of the plunger assembly being configured to release the plunger assembly from a fixed position as a result of the plunger assembly being subjected to a force that exceeds a selected threshold. In certain embodiments, means for releasably fixing the position of the first frame structure includes a pressure sensitive coupling such as a slider piston.

According to one aspect of the invention, the threshold is selected to be less than the force required to damage one of the articles. If the plunger assembly applies a displacement force and encounters in response a resistive force that exceeds the threshold, the pressure sensitive coupling allows the plunger assembly to translate away from the articles so that the displacement force is removed from the articles. In certain embodiments, the pressure sensitive coupling has a holding power that is mechanically overcome by a resistive force that exceeds the predefined threshold. In these embodiments, therefore, release by the pressure sensitive coupling is mechanically triggered. Once the holding power is insufficient to hold the plunger assembly in its operating position, it translates or slides away from the article conveyor. In other embodiments, release by the pressure sensitive coupling is electronically triggered in that it holds the plunger assembly in its operating position until it receives a control signal instructing it to release the plunger assembly from its operating position. In these embodiments, a pressure sensor may be integral to the plunger assembly in its operating position or may be incorporated in any suitable component of the system.

According to another aspect of the invention, at least one sensor continuously or periodically detects the position of the plunger assembly. The sensor transmits information about the position of the plunger assembly to a controller which, in turn, at least partially shuts down operation of the packaging machine if the sensor information indicates the plunger assembly is not in operating position. In certain embodiments, a sensor monitors the relative alignment of the first frame structure with respect the second frame structure. This sensor may be mounted on one of the frame structures and may focus on a fixed target on the other frame structure. It is contemplated that multiple sensors may be used.

The plunger assembly includes at least one, and more practically, a series of plunger elements that are each extendable and retractable to displace the articles from the article conveyor. Each plunger element is supported by a carriage as it is conveyed along a track that positions the plunger element to be extendable over the article conveyor in order to exert a displacement force against the articles.

The system for supporting and positioning the plunger assembly releasably fixes the plunger assembly in its operating position and releases the plunger assembly from its operating position when the plunger assembly is subject to resistive force that exceeds a selected threshold. In the operating position, the plunger element can apply the displacement force to displace the articles, while the plunger assembly cannot exert the displacement force when it is no longer in its operating position through release of the pressure sensitive coupling and/or operation of the rotator pistons or other suitable means for pivoting the plunger assembly.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

FIG. 3 is a plan view of the plunger assembly and system of FIG. 2.

FIG. 4 is a side elevation view of the plunger assembly and system of FIG. 2, with cutaway portions revealing the wheels, sprockets and track.

DETAILED DESCRIPTION

Figure 1:
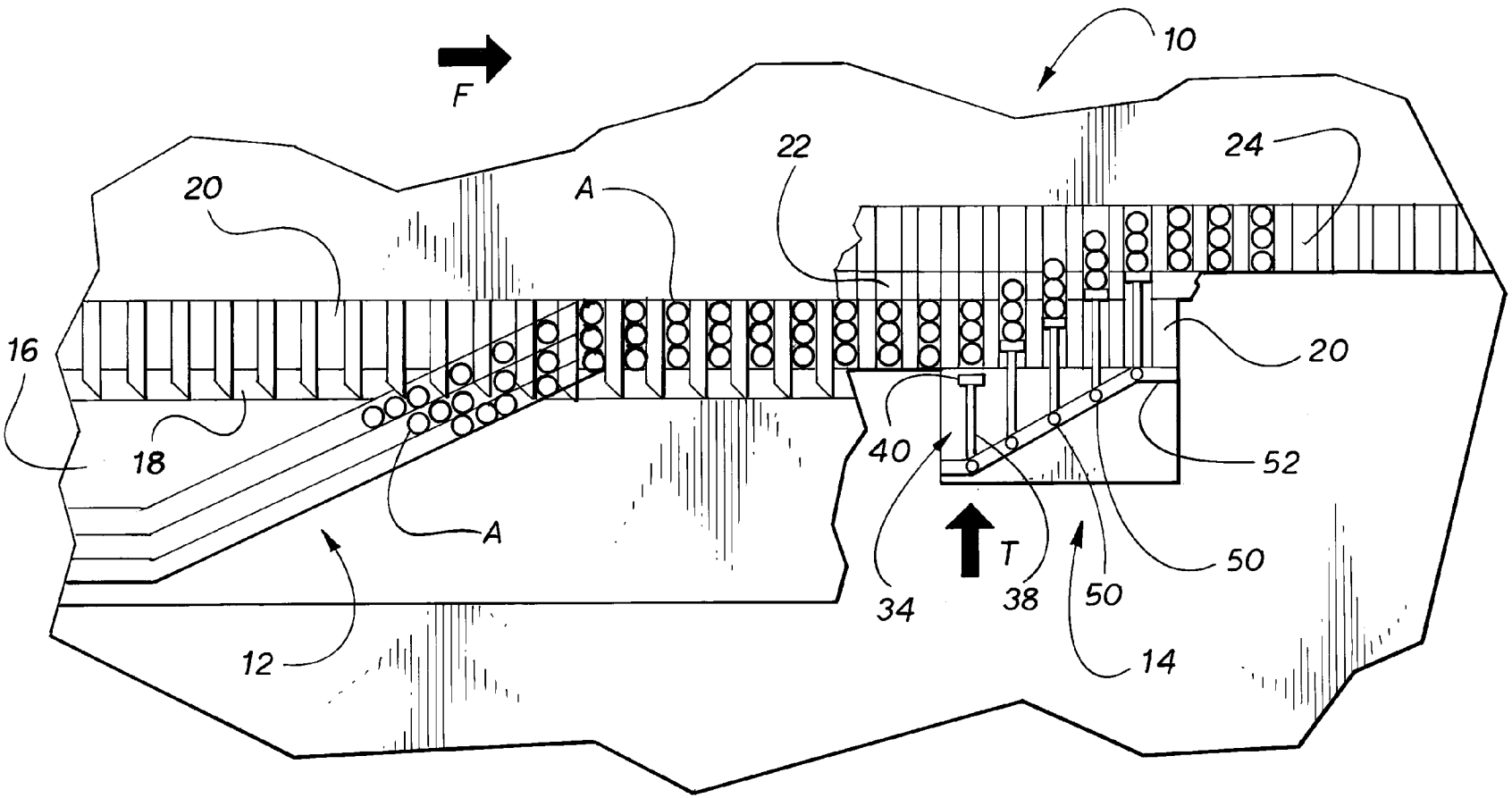
FIG. 1 is a partial plan view of a packaging machine including a plunger assembly, according to an exemplary embodiment of the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model, or pattern. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings wherein like references indicate like elements throughout the several views, the drawings illustrate certain of the various aspects of exemplary embodiments of a packaging machine that includes the plunger assembly of the present invention. Generally described, the plunger assembly is supported and positioned by a system that includes a frame assembly and means for releasably fixing the position of the plunger assembly.

Referring to FIG. 1, an exemplary packaging machine 10 is configured to load cartons C (see FIGS. 6-8) with cylindrical articles A and includes a conveying system, an infeed lane assembly 12, and a plunger assembly 14. It should be understood that the teachings provided herein can be applied to a packaging machine that is alternatively configured to load cartons with articles or to machines that are configured for use in alternative applications.

Generally described, the conveying system of the packaging machine 10 includes a plurality of substantially parallel conveyors that transport articles in a flow direction F. As the articles A move from one conveyor to the next, the articles A are separated into groups by the infeed lane assembly 12 and by lugs that are attached to certain of the conveyors. The groups are then displaced from one of the conveyors to another of the conveyors by the plunger apparatus 14.

Figure 6:
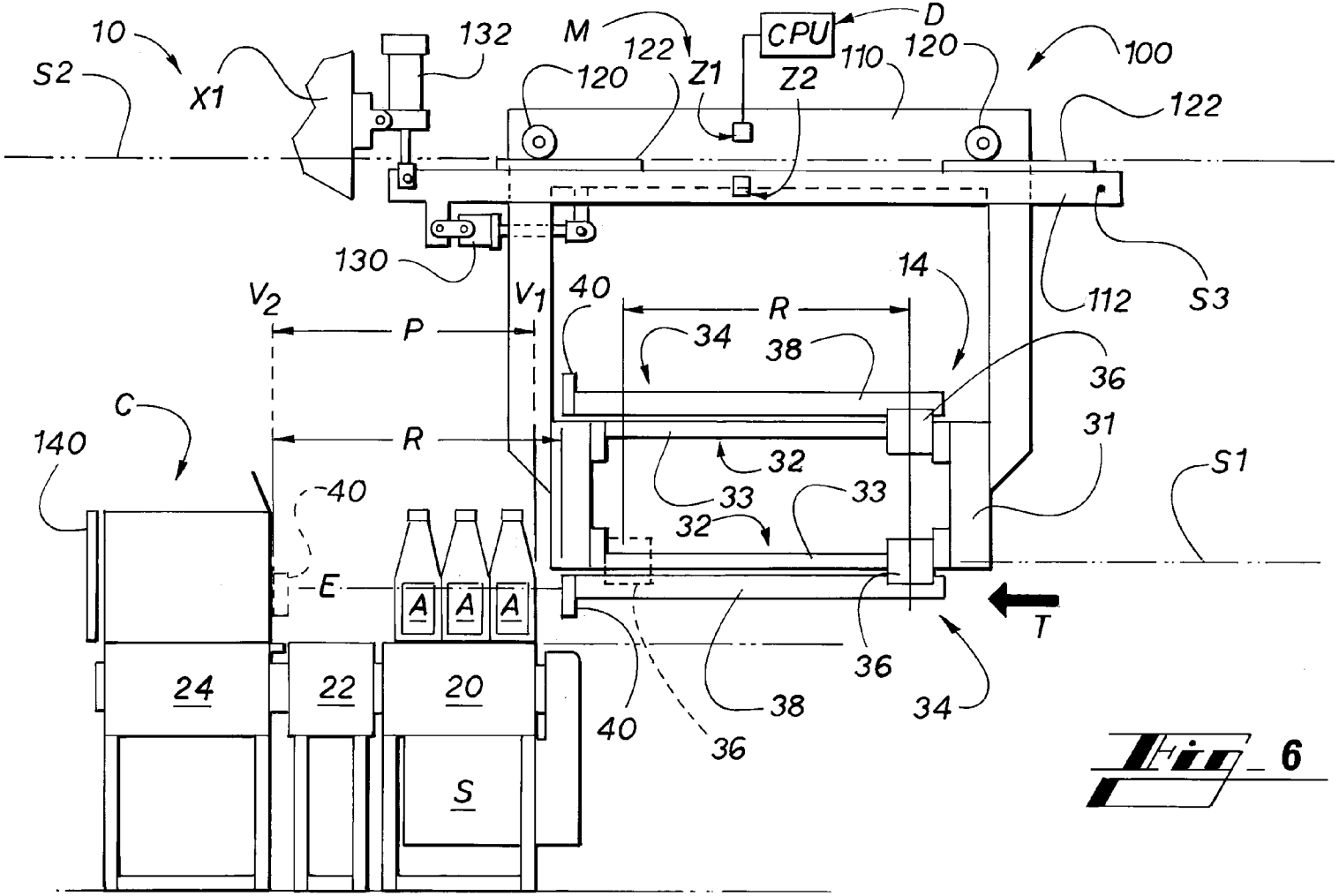
FIGS. 6-8 are end elevation views of the packaging machine of FIG. 1.
Figure 7:
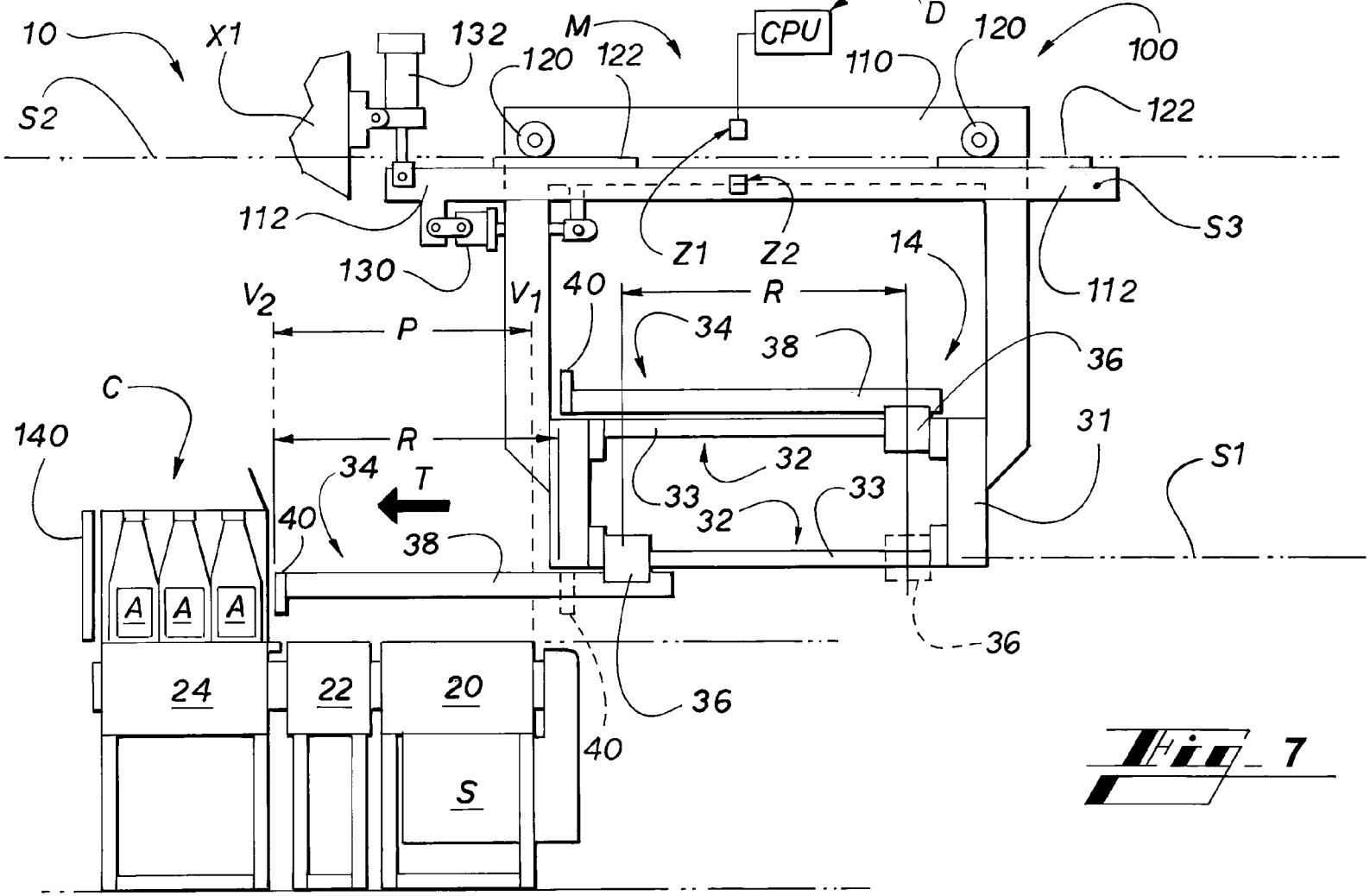

In the illustrated embodiment, the articles A are initially moved through lanes of the infeed lane assembly 12 by an infeed conveyor 16. Angled portions of the lanes direct the articles A from the infeed conveyor 16 toward a grouping conveyor 18, where lugs that are attached to the grouping conveyor 18 separate the articles A into sub-groups that continue to travel in the lanes. The sub-groups of articles A continue within the lanes and are directed onto a pocket conveyor 20 where each of the sub-groups exits the lanes and is combined with one or more other subgroups as a group on the pocket conveyor 20. The groups of articles A are then displaced from the pocket conveyor 20, across a bridge conveyor 22, and into cartons C on a carton conveyor 24 by the plunger assembly 14, as shown in FIGS. 6 and 7. In the illustrated embodiment, the articles A are displaced in a transverse direction T by the plunger assembly 14, the transverse direction T being substantially perpendicular to the flow direction F.

Figure 2:
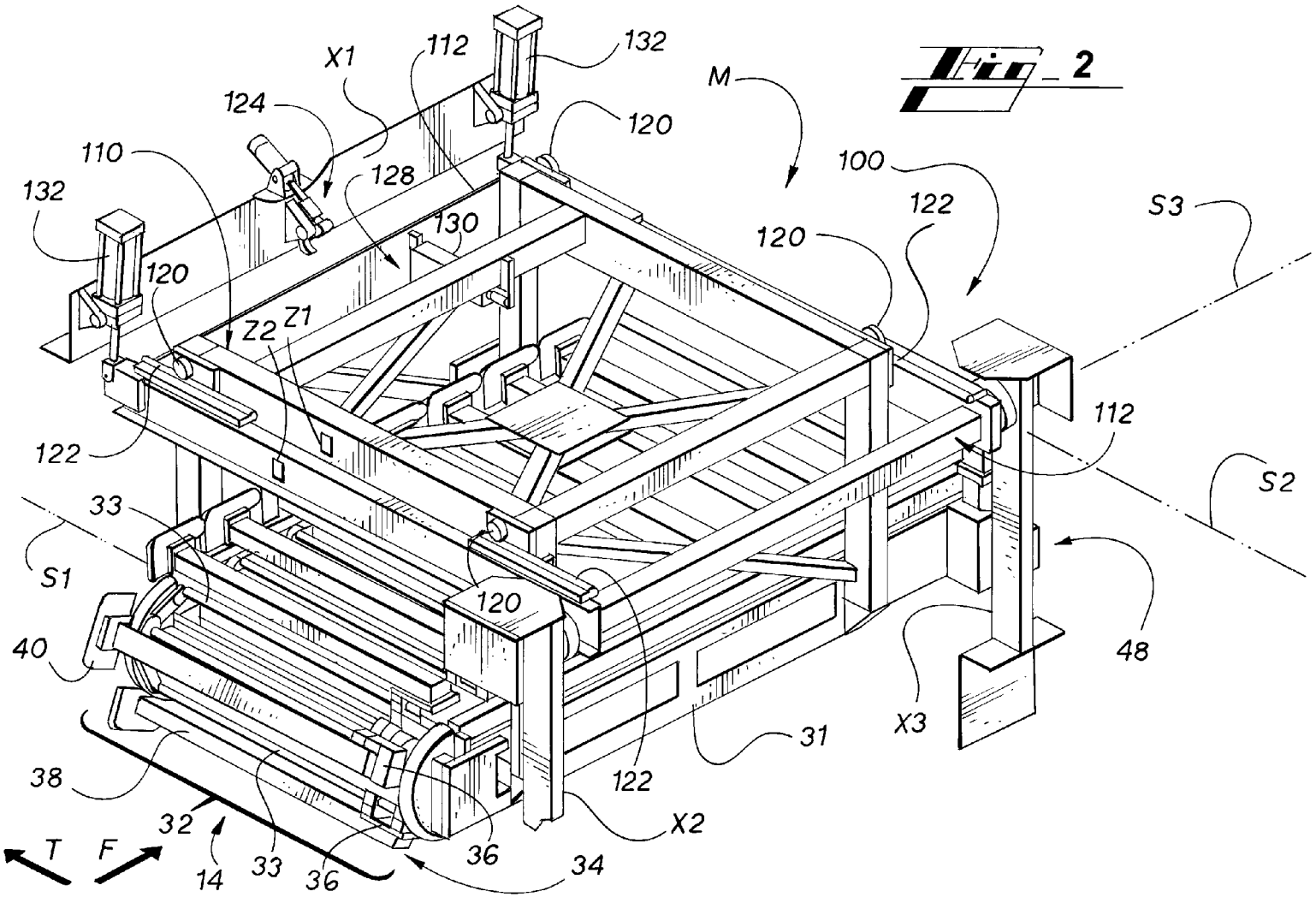
FIG. 2 is a perspective view of the plunger assembly of FIG. 1 and a system for supporting and positioning the plunger assembly.

Referring now to FIGS. 2-4, the plunger assembly 14 and a system M for supporting and positioning the plunger assembly are described. The plunger assembly 14 includes a plunger assembly frame 31 and a series of interconnected carriages 32 that are tensioned around the plunger assembly frame 31. Each carriage 32 includes rails 33 to which a plunger element 34 is slidably coupled. Each plunger element 34 includes a sliding base 36 that slides along the rails 33, an extension portion 38 that is attached to the sliding base 36, and a plunger head 40 that is positioned relative to the sliding base by the extension portion 38. The plunger head 40 is the portion of each plunger element 34 that contacts articles A. For purposes of teaching, axes S1 illustrate paths along which the plunger elements 34 translate as the plunger elements 34 slide along rails 33.

Turning to FIGS. 2-4, the plunger assembly 14 includes sprockets 42 that are driven to move the series of interconnected carriages 32 along a circuit path. The carriages 32 are guided along the circuit path as each carriage 32 includes wheels 44 that follow a track 46 formed in the plunger assembly frame 31. Accordingly, the circuit path is at least partially defined by the track 46. In the illustrated embodiment, the circuit path is substantially oval shaped, having linear portions extending between the sprockets 42 and curved portions extending around the sprockets 42. Thus, the plunger elements 34 and carriages 32 move along substantially linear paths between the sprockets 42. Particularly, as described in further detail below, the plunger assembly 14 is positioned and operated such that as the carriages 32 move along a substantially linear portion of the circuit path between sprockets and in the flow direction F, the carriages 32 travel at substantially the same speed as that of articles A on the pocket conveyor 20 so that the plunger elements 34 are optimally paced and positioned to displace articles A from the pocket conveyor 20. This portion of the circuit path is defined as an operational portion of the circuit path and is described in further detail below. It is contemplated that the teachings provided herein are applicable where the plunger assembly 14 is configured such that the carriages 32 and plunger elements 34 follow alternative paths, such as circular or elliptical paths.

The sprockets 42 can be driven by a motor 48 where the wheels 44 of the carriages 32 are engaged by recesses in the sprockets 42 to move the carriages 32 along the circuit path. Alternatively, the motor 48 can drive a roller chain that is attached to the carriages 32 to move the carriages 32 along the circuit path.

Each of the plunger elements 34 includes a cam follower 50 (shown schematically in FIG. 1) and the plunger assembly frame 31 includes a cam track 52 (shown schematically in FIG. 1). Referring to FIGS. 1 and 3, the cam followers 50 move along the cam track 52 as the carriages 32 move along the circuit path so as to transversely position the plunger elements 34 along the rails 33 of a respective carriage 32.

Accordingly, the transverse positions of the plunger elements 34 correspond to the positions of the carriages 32 along the circuit path and the path of the cam track 52. In the illustrated embodiment, the cam track 52 functions to retract the plunger elements 34 except where carriages 32 move along the operational portion of the circuit path.

Referring to FIGS. 6 and 7, each plunger element 34 can translate between the two ends of the rails 33 of a carriage 32 for a rail distance R. In other words, the two ends of the rails 33 define the limits of travel for each plunger element 34. A fully retracted position (shown in FIG. 6) can be defined as that in which movement of a plunger element 34 in a direction that is opposite the transverse direction T is limited by an end of the rails 33 and a fully extended position (shown in FIG. 7) can be defined as that in which movement of a plunger element 34 in the transverse direction T is limited by the opposite end of the rails 33. Since each plunger element 34 is substantially rigid, the rail distance R defines the maximum range of movement of the plunger head 40.

The cam 52 can be designed to select the speed and position of the plunger elements 34 in the transverse direction T relative to the speed and position of the carriages 32 along the operational portion of the circuit path. The cam 52 can be designed to reduce the travel range of the plunger head 40 in embodiments where a larger rail distance R is allowed. Additionally, the speed and position of the plunger elements 34 can be adapted to correspond to a different displacement distance by changing the cam 52 rather than changing the position of the plunger assembly 14 or changing the plunger elements 34.

Referring to FIGS. 2-8, a frame assembly 100, in combination with means for positioning, provide a system M that can support and position the plunger assembly 14. In particular, the system M can releasably fix the position or further limit the travel range of the plunger assembly 14 to provide an overload release feature for the plunger assembly 14.

The frame assembly 100 includes a slidable frame structure 110 that is slidably coupled to a base frame structure 112. The plunger assembly frame 31 is attached to the slidable frame structure 110 such that the plunger assembly 14 is supported and vertically positioned, as described in further detail below. The plunger assembly 14 is horizontally positionable as the slidable frame structure 110 is slidable relative to the base frame structure 112.

In the illustrated embodiment, the slidable frame structure 110 is slidably coupled to the base frame structure 112 by a wheel 120 and rail 122 arrangement. Wheels 120 are attached to the slidable frame structure 110 and rails 122 are attached to the base frame structure 112. The wheels 120 are set on the rails 122 and can roll along the rails 122. For purposes of teaching, displacement axes S2 illustrate paths along which the slidable frame structure 110 translates as the wheels 120 roll along rails 33.

In the illustrated embodiment, the plunger assembly 14 and frame assembly 100 are configured such that the displacement axes S1 and the displacement axes S2 are substantially parallel to one another and are substantially transverse to an axis that is defined by the flow direction F. The slidable frame structure 110 and the plunger elements 34 can each be positioned to translate in or opposite a transverse direction T along the rails 122, 33, respectively.

It is contemplated that, in alternative embodiments, means for slidably coupling the slidable frame structure 110 to the base frame structure 112 can include roller bearings, rack and pinion arrangements, frictional bearings, flexible bearings, fluid film bearings, magnetic bearings, combinations thereof, and the like.

In the illustrated embodiment, means for positioning the plunger assembly 14 includes a pressure sensitive coupling 128 that is attached to the sliding frame structure 110 and to the base frame structure 112, or to another element of the packaging machine that is fixed. In the embodiments described herein, the pressure sensitive coupling 130 is a slider piston 130 that is pivotably attached at one end to the sliding frame structure 110 and pivotably attached at the opposite end to the base frame structure 112. As used herein, the term "piston" refers to telescoping device, such as a linear actuator, having a cylinder and a shaft that is extendable to produce linear motion from an available energy source, such as the resistive pressure or force generated by a toppled article or an electronic signal. Suitable pistons may be mechanically, piezoelectrically or hydraulically driven by linear forces, although utilization of mechanical or electromechanical actuators that translate rotary forces into linear motion are also contemplated.

In the various embodiments that are contemplated, one end of the slider piston 130 can be attached to one of the sliding frame structure 110 and the plunger assembly frame 31 and the opposite end of the slider piston 130 can be attached to one of the base frame structure 112, a frame X1 of the packaging machine 10, a frame of the pocket conveyor 20, and any fixed or static surface of the packaging machine or environment.

The extension and retraction of the slider piston 130 are controllable to move and position the slidable frame structure 110 along the rails 122. Further, the slider piston 130 can extend to a selected length and remain extended at the selected length until a force that exceeds a selected threshold is applied to the slider piston 130. Thereby, the slider piston 130 can releasably fix the position of the plunger assembly 14 during normal operation until, for example, a plunger element 34 is obstructed during the packaging operation, as described in further detail below.

Figure 8:
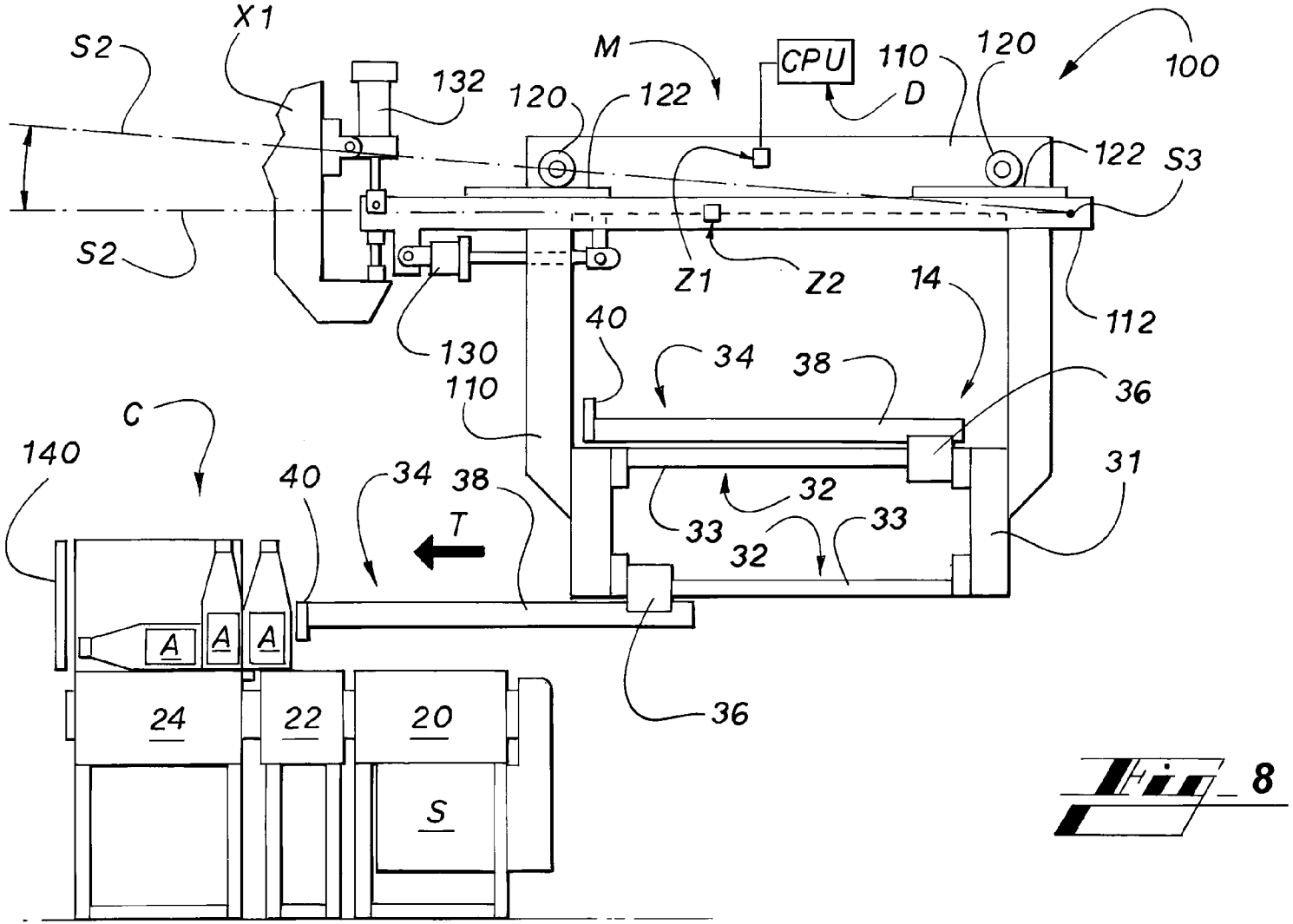

The base frame structure 112 is pivotably attached to pivotal support structures X2, X3 at a proximal end thereof so as to be pivotable about a rotational axis S3. A distal end of the base frame structure 112 is attached to the frame X1 of the packaging machine 10 by rotator pistons 132. The extension and retraction of the rotator pistons 132 pivots and angularly positions the base frame structure 112 about the rotational axis S3. Referring to FIG. 8, the distal end of the base frame structure 112 can rest on a vertically adjustable ledge of the frame X1 to set the resting angular position of the base frame structure 112.

Figure 5:
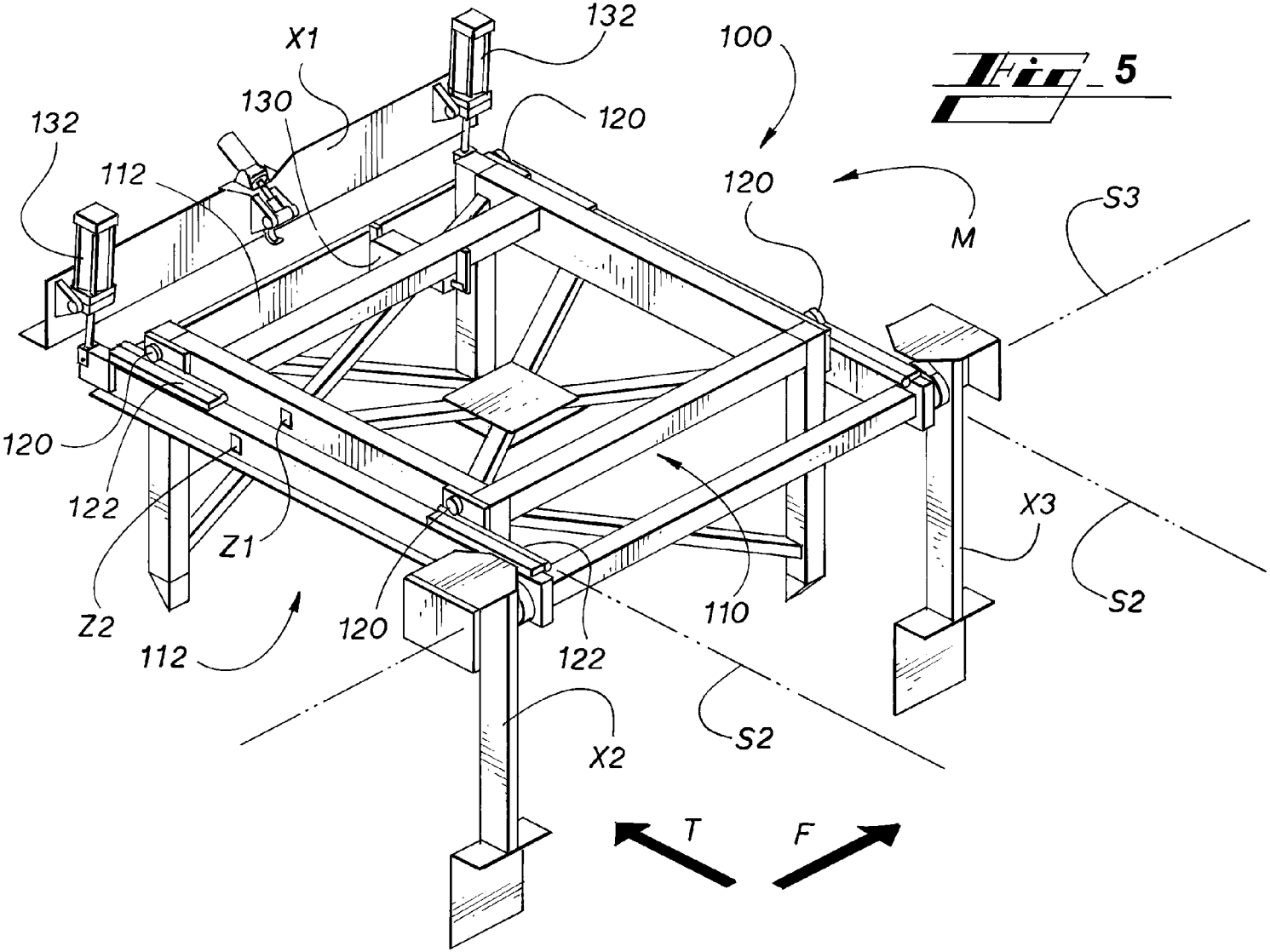
FIG. 5 is a perspective view of the system of FIG. 2.

Continuing momentarily with FIG. 8, two different positions are represented by the illustration of the displacement axis S2 at a resting angular position and at a displaced angular position. Advantageously, the base frame structure 112 can be positioned at a slight angle to provide a bias such that the plunger assembly 14 tends to roll in one direction or the other along the rails 122, which can facilitate the operation of the overload release feature. The base frame structure 112 can also be positioned at a relatively large angle, for example, to provide access to the pocket conveyor 20 from underneath the plunger assembly 14. Referring to FIGS. 2, 4, and 5 the base frame structure 112 can be supported in the displaced angular position by a catch 124 that is configured to engage the base frame structure 112. The catch 124 is configured to matingly engage an aperture, indentation, notch, lip, or other mating element formed in the base frame structure.

In the illustrated embodiment, the rotational axis S3 is substantially perpendicular to the displacement axes S1, S2 and is substantially parallel to the flow direction F. The base frame structure 112 can pivot about the rotational axis S3 to be positioned such that a plane defined thereby is at an angle with respect to a horizontal plane.

An operating position of the plunger assembly 14 is now described. Referring to FIGS. 6 and 7, under normal operating conditions, the plunger assembly 14 is positioned by the system M in an operating position, which is defined herein as the position in which the plunger assembly 14 is positioned displace articles A over a displacement distance P. In the illustrated embodiment, the displacement distance P is that which is required to transversely displace articles A from the pocket conveyor 20 to the carton conveyor 24. For example, the displacement distance P can be defined between parallel vertical planes V1, V2, where the vertical plane V1 extends along an edge of the conveying surface of the pocket conveyor 20 and the vertical plane V2 extends along an edge of the conveying surface of the carton conveyor 24.

Referring to FIGS. 6-8, the system M includes position sensors Z1, Z2 that can indicate when the plunger assembly 14 is in or out of the operating position. In the illustrated embodiment, the position of the plunger assembly 14 can be inferred from the relative position of the sliding frame structure 110 and the base frame structure 112. Accordingly, a first sensor Z1 is attached to the sliding frame structure 110 and a second sensor Z2 is attached to the base frame structure 112. Those skilled in the art will understand that there may be alternative sites for placement of any number of sensors to detect the position of the plunger assembly 14.

The sensors Z1, Z2 provide an output to a controller D, such as the central processing unit (CPU) functionally illustrated in FIG. 6. It should be noted that the controller D may include any number of processing units distributed or centrally located to control any number of functions of the packaging process in a networked or independent fashion. The controller D executes computer readable instructions stored on a storage medium such as a hard drive or flash memory or communicated via any suitable input/output device, such as a keyboard, touchscreen or joystick.

The illustrated arrangement of sensors Z1, Z2 provides a first output when the sensors Z1, Z2 are aligned and a second output when the sensors Z1, Z2 are misaligned. Thus, referring to FIG. 6, the arrangement of sensors Z1, Z2 provides a first output when the plunger apparatus 30 is in the operating position and, referring to FIG. 8, provides a second output when the plunger apparatus 30 is displaced from the operating position.

It should be understood that the sensors can be alternatively arranged or positioned with respect to the frame assembly 100, for example, to detect the operating position. Those skilled in the art will readily appreciate that one or both of the sensors Z1, Z2 may be active devices, and that the sensors Z1, Z2 may be aimed at one another or at stationary targets. In variations of the illustrated embodiment, one or more sensors that detect the extended length of the rotator piston 132 may be employed to detect the angular position of the base frame structure 112.

The output of the position sensors Z1, Z2 can provide a trigger for the drive of the packaging machine 10 such that the packaging machine 10 is only operational when the plunger assembly 14 is positioned in the operating position. Thereby, for example, as toppled articles A provide an obstruction and force the plunger assembly 14 from the operating position, the packaging machine 10 shuts down and the toppled articles A can be removed.

Referring to FIGS. 6 and 7, the operating position of the plunger assembly 14 is further described. The plunger assembly 14 is vertically positioned by the frame assembly 100 such that, along the operational portion of the circuit path, the plunger elements 34 are positioned to move in a substantially horizontal engagement plane E so as to intersect articles on the pocket conveyor 20 at an optimal height. Thereby, few, if any, articles A are toppled by the plunger elements 34. However, the packaging machine 10 is configured to respond to toppled articles A or other obstructions, as described in further detail below.

The rail distance R is greater than or equal to the displacement distance P. The position of the plunger assembly 14 and the size and shape of the extension portion 38 are design choices that are dependent on one another, as well as on the rail distance R. Additional parameters include the particular application, carton size, number and size of articles, and the width of the conveyors. These design choices are made such that the plunger head 40 will translate in the engagement plane E and such that the plunger head 40 is able to move in the transverse direction T at least between the vertical planes V1, V2 that define the displacement distance P. In certain embodiments where the rail distance R is greater than the displacement distance P, the horizontal position of the plunger assembly 14 and the size and shape of the extension portion 38 can be selected with increased flexibility.

In the illustrated embodiment, the extension portion 38 of each of the plunger elements 34 is substantially straight and extends substantially horizontally in the transverse direction T from the sliding base 36. The extension portion 38 is horizontally aligned with the plunger head 40 and is thereby disposed in the engagement plane E along the operational portion of the circuit path. By positioning the plunger assembly 14 such that the extension portion 38 of the plunger element 34 extends horizontally, the vertical distance between the plunger head 40 and the sliding base 36 is minimized. Minimizing this vertical distance reduces the moment or rotational force on the sliding base 36 that occurs when the plunger head 40 engages articles A.

The extension portion 38 is substantially the same length as the rail distance R. The plunger assembly 14 is positioned such that the engaging face of each plunger head 40 extends no further than substantially coplanar with the vertical plane V1 when each plunger element 34 is in a fully retracted position. In the illustrated embodiment, the rail distance R is substantially the same as the displacement distance P such that the engaging face of each plunger head 40 extends at least to be substantially coplanar with the vertical plane V2 when the plunger element 34 is in a fully extended position.

Continuing with FIGS. 6 and 7, under normal operating conditions, the slider piston 130 releasably fixes the position of the plunger assembly 14 in the operating position such that the plunger elements 34 can apply a displacement force to push groups of articles A into cartons C. It should be noted that the frictional forces between the articles A and the conveyor surfaces are such that the resultant resistive force from moving the articles A is below a selected threshold for the slider piston 130.

Turning to FIG. 8, an exemplary method of operation of the packaging machine 10 in response to an overload condition is now described. In certain situations, an impeding object, such as a toppled group of articles A, sufficiently impedes the displacing action of one or more of the plunger elements 34. In the case of a toppled group of articles A, the articles A can be lodged in between a stop plate 140 and the plunger element 34. If the resistive force applied against the plunger element 34 exceeds a selected threshold, the displacing action and force of the plunger elements 34 is backed off and the operation of the packaging machine 10 is halted such that the impeding object can be removed before continuing normal operations. Advantageously, the chance that the toppled article A will be crushed by the plunger element 34 is thereby greatly reduced.

In certain embodiments, upon reaching a selected threshold, the displacement force supplied by the plunger element 34 pushing against the impeding object is sufficient to overcome the holding strength of the sliding piston 130. Accordingly, the displacing action of the plunger element 34 functions to push the plunger assembly 14 from the operating position, which relieves the force of the plunger element 34 on the impeding object. The holding strength of the sliding piston 130 may be mechanically determined, such as but not limited to, by one or more detents within the device.

In alternative embodiments, once the force generated by the overload condition reaches a selected threshold, an overload condition is indicated and communicated to the controller D, which in response, triggers automatic extension of the slider piston 130 to slide the plunger assembly 14 from the operating position. The force generated by the overload condition may be electronically measured and communicated to the controller D, which signals the slider piston 130 to extend to remove the plunger assembly 14 from the operating position.

In either case, once the plunger assembly 14 moves from the operating position, the position sensors Z1, Z2 become misaligned and the controller D shuts down the packaging machine 10.

To clear toppled or broken articles A from the conveyors, the plunger assembly 14 can be positioned such that the plunger assembly 14 is displaced and pivoted away from the conveyors. In the illustrated embodiment, each of the slider and rotator pistons 130, 132 can be selectively retracted or extended to provide access space between the conveyors and the plunger assembly 14.

This space allows a human operator (not shown) or a robotic component (not shown) to access portions of the packaging machine that are normally difficult to access when the plunger assembly 14 is in operating position, thereby facilitating rapid clearance of toppled articles and damaged cartons.

This pivoting motion can be accomplished electronically, by operation of the controller D, or manually. For instance, upon occurrence of an overload condition, the controller D may simultaneously or consecutively trigger extension of the rotator pistons 132 in addition to extension of the slider piston 130, thereby preventing damage and providing access for clearance of the toppled article.

The above-described embodiments are merely exemplary illustrations of implementations set forth for a clear understanding of the principles of the invention. Variations, modifications, and combinations may be made to the above-described embodiments without departing from the scope of the claims. For instance, the pistons described herein may retract rather than extend to perform the functions detailed. All such variations, modifications, and combinations are included herein by the scope of this disclosure and the following claims.

What is claimed is:

1. A packaging machine, comprising:

an article conveyor for transporting articles;

a plunger assembly for displacing articles from the article conveyor;

a system for supporting and positioning the plunger assembly, the system comprising means for releasably fixing the position of the plunger assembly in an operating position and for releasing the plunger assembly from its fixed position when the plunger assembly is subject to a force that exceeds a selected threshold; and a frame assembly comprising a first frame structure attached to the plunger assembly and a second frame structure, wherein the first frame structure and the second frame structure are slidably coupled to one another and the second frame structure can be pivoted away from the article conveyor to move the plunger assembly out of its operating position to provide access to the article conveyor.

2. The packaging machine of claim 1, wherein the system further comprises at least one rotator piston for pivoting the second frame structure.

3. The packaging machine of claim 1, wherein the means for releasably fixing the position of the plunger assembly comprises a pressure sensitive coupling.

4. The packaging machine of claim 3, wherein the pressure sensitive coupling comprises a slider piston.

5. The packaging machine of claim 1, wherein the threshold is selected to be less than the force required to damage one of the articles.

6. The packaging machine of claim 1, further comprising at least one sensor for detecting the position of the plunger assembly.

7. The packaging machine of claim 6, further comprising a controller for receiving a signal from the at least one sensor, and for at least partially halting operation if the signal indicates the plunger assembly is not in operating position.

8. A packaging machine, comprising:

an article conveyor for conveying articles;

a plunger assembly, comprising:

at least one plunger element that is extendable and retractable to displace articles from the article conveyor; and a carriage for supporting the at least one plunger element as it is conveyed along a track that positions the at least one plunger element to be extendable over the article conveyor to exert a displacement force against the articles; and a system for supporting and positioning the plunger assembly, the system being for releasably fixing the plunger assembly in an operating position and for releasing the plunger assembly from its operating position when the plunger assembly is subject to resistive force that exceeds a selected threshold.

9. The packaging machine of claim 8, wherein, in the operating position, the at least one plunger can apply the displacement force to displace the articles.

10. The packaging machine of claim 8, wherein the system further comprises a frame assembly, comprising a first frame structure attached to the plunger assembly.

11. The packaging machine of claim 10, wherein the system further comprises a pressure sensitive coupling that releases the plunger assembly from its operating position by translating the first frame structure away from the article conveyor.

12. The packaging machine of claim 11, further comprising a second frame structure;

wherein the first frame structure and the second frame structure are slidably coupled to one another, and the pressure sensitive coupling is connected to both the first frame structure and the second frame structure.

13. The packaging machine of claim 12, wherein the second frame structure can be pivoted away from the article conveyor to move the plunger assembly out of its operating position to provide access to the article conveyor.

* * * * *